United States Patent [19]

Vercoulen

[11] 4,077,713

[45] Mar. 7, 1978

[54] COPYING APPARATUS WITH MOVING BELT FOR TRANSFERRING IMAGES

[75] Inventor: Johannes C. A. Vercoulen, Venlo, Netherlands

[73] Assignee: Oce-van der Grinten, N.V., Venlo, Netherlands

[21] Appl. No.: 663,710

[22] Filed: Mar. 4, 1976

[30] Foreign Application Priority Data

Mar. 11, 1975 Netherlands ..... 7502873

[51] Int. Cl.[2] ..... G03G 15/00

[52] U.S. Cl. ..... 355/16; 226/119

[58] Field of Search ..... 355/16, 3 BE; 226/119; 354/321

[56] References Cited

U.S. PATENT DOCUMENTS

| | | | |
|---|---|---|---|
| B 481,048 | 3/1976 | Toto et al. | 355/16 |
| 2,226,187 | 12/1940 | Van Derhoef et al. | 226/119 |
| 3,737,088 | 6/1973 | Barta et al. | 226/119 |
| 3,942,190 | 3/1976 | Detwiler | 226/119 |
| 3,944,354 | 3/1976 | Benwood et al. | 355/16 |

*Primary Examiner*—Richard L. Moses
*Attorney, Agent, or Firm*—Albert C. Johnston

[57] ABSTRACT

In copying apparatus utilizing an endless belt to hold electrostatic or powder images and carry them through a station for transfer to a receiving surface, the belt is arranged for movement through a path containing turns where it is engaged by rollers, with some of these rollers contacting its image bearing side, and each roller so contacting the belt is constituted by freely rotatable narrow roller members which contact it only in narrow margins along its opposite edges, so outside the surface regions that usually carry the images. A considerable length of the belt can be held in a close undulating path, as in a compact magazine, by a series of rollers arranged in parallel rows with each roller in one of these rows constituted by such narrow roller members engaging the image bearing side of the belt.

5 Claims, 3 Drawing Figures

COPYING APPARATUS WITH MOVING BELT FOR TRANSFERRING IMAGES

This invention relates to a copying apparatus of a kind provided with a moving endless belt for transferring electrostatic or powder images, which belt is passed over a series of rollers reversing its direction of movement.

Various forms of apparatus of that kind are known. Depending upon the copying process to be used, the belt used comprises a photoconductive or insulating top layer, elastic or non-elastic, which for obtaining sufficient mechanical strength is coated on a suitable flexible support material, such as paper or a metal or synthetic resin sheet material, with or without one or more anchoring or intermediate layers.

Depending upon its nature, the top layer of the belt can be used many times for image formation and transfer of the image, for instance 100–1000 times, after which the belt must be replaced. In order to limit the need for belt replacement, so that a great number of copies can be made from a given belt, it is known to use a long endless belt and to store a large part of its length in a magazine into which it is fed continuously and from which it is pulled outward during the copying. Such a magazine for a photoconductive belt used for image transfer is described in U.S. Pat. No. 3,756,488, wherein the belt is provided with a great number of folds so that it can be laid down in zigzag manner as it is fed into the magazine. It is not always desirable, however, and not always possible without detriment, to provide the belt with many sharp folds. Moreover, a magazine such as that mentioned is not always necessary; for instance, it is not needed if the belt length to be contained in the magazine is sufficiently limited that it can be arranged conveniently to pass over a series of rollers.

When such a belt is so arranged over rollers, some of the rollers can engage the rear side of the belt but other rollers will engage with its top layer. This has the disadvantage that there is great risk of damage to the top layer, and wear of this layer is accelerated so that the belt must be replaced sooner than would be necessitated by the characteristics of the copying process.

The object of the present invention is to provide a copying apparatus of the kind above mentioned by which such wear and risk of damage to the belt can be reduced advantageously.

According to the invention, an apparatus of the kind mentioned is characterized in that the endless belt is passed in meandering manner through a magazine constituted by a series of belt reversing rollers arranged in parallel rows, and at least each of the rollers engaged by the side of the belt that serves for the image transfer has its peripheral surface formed by two narrow rollers which contact only narrow margins of the belt and are freely rotatable about a common axis.

The invention takes advantage of the fact that the belt comprises marginal regions which normally are not used for copying. Although it was to be expected that the tension occurring in the belt when it is driven would cause the belt to sag between belt turning rollers that would support only the margins of the belt, it has been found that this is not the case in many arrangements which are suitable for practical use.

Thus, it has been found, for instance, that a belt made with a base of a resin sheet material ("Melinex") having a width of 42 cm and a thickness of 100$\mu$, though tightened by a driving force of about 20 kgs, shows no sagging when the margins of the belt are supported by rollers having a length of 2 cms and a diameter of 3 cms with portions of the belt bent about each roller through a turn of 180°. It has also been found that the working conditions can be adapted to the character of the belt by varying the tension in the belt, the diameter of the supporting rollers and/or the turn angle of belt bends about the rollers. For instance, a belt made with a paper base having a thickness of 100$\mu$ will show a tendency to sag under the work conditions described in relation to a Melinex belt, but sagging will not occur, for instance, when the paper belt is of smaller width, for instance 25 cms, and/or is tightened with less force, for instance being driven with a force of 10 kgs, and/or the supporting rollers have a smaller diameter, for instance of 1.5 cm.

The invention will be further understood from the following description and the accompanying drawing of an illustrative embodiment thereof. In the drawing.

Figure 1:
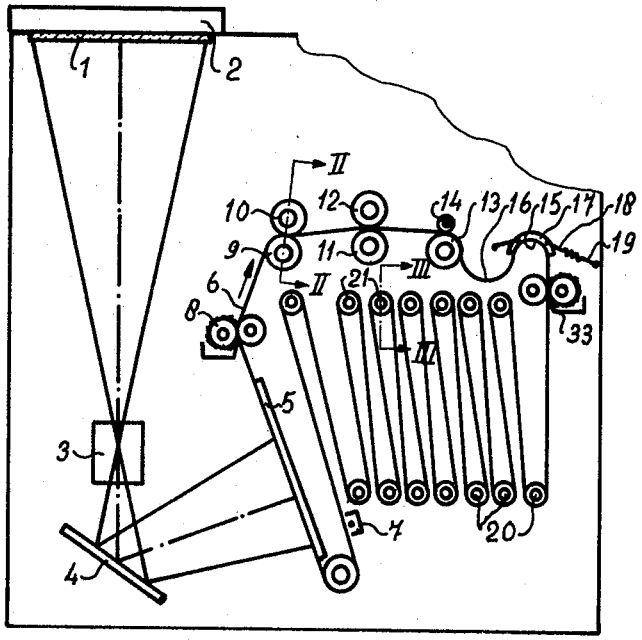
FIG. 1 is a schematic side view of a portion of an electrophotographic copying apparatus embodying the invention.

The apparatus illustrated in the drawing is arranged and functions, generally speaking, as follows: An original to be copied can be laid on a glass plate 1 and pressed down against the plate by a pressure cushion 2. The original then can be exposed from beneath by flashlamps (not shown) to produce an image of the original which is projected onto an endless photoconductive belt 6 via a lens 3 and mirror 4. The belt 5 is driven by roller 9, which may be made with a coating having a high coefficient of friction and which coacts with a pressure roller 10 as further described below.

From a magazine to be described below the belt 6 extends through a charging station where a corona device 7 applies a uniform electrostatic charge to the photoconductive layer of the belt. The belt then passes over a flat suction box 5, being held flat there to receive the image produced by a flash exposure of the original. The belt thus acquires an electrostatic latent image corresponding to the original, by discharge in the areas of the photoconductive layer struck by the projected light.

The latent image, or charge pattern, is now developed into a powder image in a usual way, for instance by means of a magnetic brush developing unit 8 engaging the belt beyond the exposure station. Then the belt carrying the powder image passes over the drive roller 9 and thence through a transfer station at rollers 11, 12, where the powder image can be transferred to a receiving surface in a known way. For instance, with proper selection of the surface of roller 12, the image can be transferred to that surface by pressure between the rollers 11 and 12. Roller 12 can then, for instance, transfer the powder image to copy paper being conveyed over its surface, in a known manner having no further relation to the present invention. Preferably the roller 12 has a surface layer of a soft and elastic material, for instance a soft silicone rubber.

Any residue of the powder image being left on belt 6 is removed by passing the belt through a cleaning station containing a brush unit 33. Upstream of this station, the belt 6 is kept properly aligned by passing it over a stationary curved surface 15 from a smooth roller 13 coacting with a pressure roller 14. The curved surface 15 has raised side guides 17 engageable by either side edge of the belt, and it is overlaid by a cloth 18 which is kept under substantially constant tension by a spring 19 so that it presses the belt yieldingly against the surface 15. The smooth roller 13 drives the belt forward from the transfer station and maintains between itself and surface 15 a slack, freely hanging belt length 16. The belt thus is kept aligned substantially as described in U.S. Pat. No. 3,846,021. The cloth 18 may consist of strips of felt arranged over the whole width of the belt, but preferably, according to the present invention, narrow felt strips 18 are provided only near the side edges of the surface 15.

After passing the brush unit 33, the belt passes into the magazine above mentioned, which is formed by a large number of rollers 20 and 21. These rollers support and guide the belt in a close zigzag or undulating path, so that a great length of belt can be kept trained about them. In this way, the total length of the belt can amount, for instance, to between 5 and 20 meters.

Figure 3:
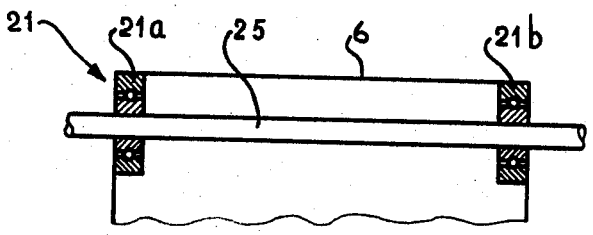
FIG. 3 is a longitudinal cross section through a belt turning roller, taken along line III—III in FIG. 1.

The rollers 20 engage against the under or non-image bearing side of the belt 6; so they may be ordinary guide rollers rotatable in contact with the belt over its full width. The rollers 21, however, engage against the upper or image-bearing side of the belt, which carries the photoconductive layer. According to the invention, these rollers are made in a special manner. As indicated in FIG. 3, each of the rollers 21 is made with two relatively narrow roller members 21*a* and 21*b*, which engage only against the margins of the belt 6 and are freely rotatable about a common shaft 25. In the preferred embodiment illustrated, the narrow members of each roller 21 are formed by ball bearing units having their inner rings fixed on the shaft 25. While it is also practicable to provide the roller members on separate journals, so that they need not be supported by a common shaft 25, a common shaft is advantageous in that it enables the roller members to be adjusted better relative to each other.

The members 21*a* and 21*b* of a roller 21 need not always be freely rotatable relative to each other, but it appears to be beneficial, for easier and better alignment of the belt, to have them freely rotatable relative to each other.

Figure 2:
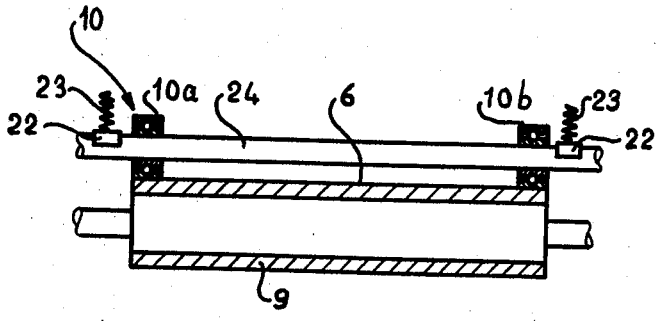
FIG. 2 is a longitudinal cross section through a pair of belt driving rollers, taken along line II—II in FIG. 1.

FIG. 2 of the drawing shows schematically the arrangement of the pressure roller 10 which cooperates with the belt driving roller 9 provided with a friction coating. The roller 10 is made with two narrow roller members 10*a* and 10*b* which are mounted on a common shaft 24 and which engage against narrow marginal regions only of the belt 6. These roller members may also be formed by ball bearing units. They are freely rotatable relative to each other, and they are pressed toward the roller 9, so against narrow margins of the belt which normally are not used for image formation, under a suitably selected force applied by compression springs 23 bearing against shoes 22 on the shaft 24.

The pressure roller 14 which cooperates with the smooth roller 13 in the arrangement of FIG. 1 may also be constituted by two narrow rollers which are freely rotatable relative to each other and engage against only the margins of the belt. The members of roller 14, however, can press only lightly against the belt; so they need not be pressed in the same way as the roller 10.

In the event that an endless transfer belt is used instead of the roller 12 for transferring the powder image from the belt 6, as is known for such purpose, a roller structure having narrow members engaging only margins of the transfer belt may be provided according to the invention for engagement with the transfer belt at locations where it is to be turned by roller engagement with its image carrying side. This application of the invention may be quite advantageous as a means to enable desirable arrangements of the transfer belt in a limited space available in the copying apparatus and/or for keeping the transfer belt aligned and passing it along a heating station where the powder image is rendered sticky for better transfer to the copy paper.

What is claimed is:

1. In a copying apparatus including an endless belt having an image bearing side comprising a photoconductive layer, means for drawing said belt continuously through at least one imaging station for the formation of an electrostatic or powder image on an area of said layer and then passing the belt to a station for transfer of the image to a receiving material, and a magazine downstream from the transfer station for storing a major portion of the length of said belt so that any area thereof used for the formation and transfer of an image stays in the magazine during at least a minimum rest period before moving again to an imaging station, the improvement which comprises said belt being supported in and transported through the magazine on a multiplicity of rollers freely rotatable about parallel fixed axes and arranged in spaced apart, substantially parallel rows, the length of said belt in said magazine extending in an undulating path through successive direction reversing turns about respective rollers of said rows in alternation so that the image bearing side of the belt bears against rollers of one of said rows and the back side of the belt bears against rollers of the other row, and means upstream of said rollers for maintaining under a preset tension the length of belt that extends through the magazine and from it through said at least one imaging station to said belt drawing means, each of the rollers of said one row being constituted by two narrow roller members which are freely rotatable relative to each other on a common axis and which contact only narrow marginal portions of said belt along its opposite edges; whereby said major portion of the belt length is stored in a compact space without folding or sagging of the belt and without damaging the normal working area of said photoconductive layer.

2. Copying apparatus according to claim 1, said rollers of said other row being rollers which engage said belt over its full width.

3. Copying apparatus according to claim 1, said two narrow roller members each being the outer ring of a ball bearing unit the inner ring of which is fixed at a desired position on a coaxial supporting shaft common to said two roller members.

4. Copying apparatus according to claim 1, said belt comprising a base of flexible plastic sheet material having a width of the order of 42 cm. and a thickness of the order of 100 microns, said narrow roller members each having an axial length of about 2 cm. and an outside diameter of about 3 cm.

5. Copying apparatus according to claim 1, said belt comprising a base of paper having a width of the order of 25 cm. and a thickness of the order of 100 microns, said narrow roller members each having an axial length of about 2 cm. and an outside diameter of the order of 1.5 cm.

* * * * *